US009718285B2

(12) United States Patent
Kokuta

(10) Patent No.: US 9,718,285 B2
(45) Date of Patent: Aug. 1, 2017

(54) PRINTER

(71) Applicant: SATO HOLDINGS KABUSHIKI KAISHA, Tokyo (JP)

(72) Inventor: Hiroshi Kokuta, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/108,031

(22) PCT Filed: Dec. 25, 2014

(86) PCT No.: PCT/JP2014/084353
§ 371 (c)(1),
(2) Date: Jun. 24, 2016

(87) PCT Pub. No.: WO2015/099061
PCT Pub. Date: Jul. 2, 2015

(65) Prior Publication Data

US 2016/0325563 A1 Nov. 10, 2016

(30) Foreign Application Priority Data

Dec. 26, 2013 (JP) ..... 2013-268262

(51) Int. Cl.
*B41J 11/00* (2006.01)
*B41J 15/04* (2006.01)
*B41J 15/16* (2006.01)

(52) U.S. Cl.
CPC ..... *B41J 11/0045* (2013.01); *B41J 15/042* (2013.01); *B41J 15/046* (2013.01); *B41J 15/16* (2013.01)

(58) Field of Classification Search
CPC ..... B41J 13/00; B41J 13/0009; B41J 15/00; B41J 15/04; B41J 15/044; B41J 15/046; B41J 25/304; B41J 25/308; B41J 25/3082; B41J 11/0045
See application file for complete search history.

(56) References Cited

U.S. PATENT DOCUMENTS 6,622,622 B2 9/2003 Lee et al.

FOREIGN PATENT DOCUMENTS

| | | | |
|---|---|---|---|
| JP | 62-50958 | U | 3/1987 |
| JP | 63-88651 | U | 6/1988 |
| JP | 7-149435 | A | 6/1995 |
| JP | 2003-246514 | A | 9/2003 |

*Primary Examiner* — Kristal Feggins
(74) *Attorney, Agent, or Firm* — Foley & Lardner LLP

(57) ABSTRACT

In a printer for printing on a label of a continuous paper in a middle of feeding the continuous paper unwound from a paper sheet supply unit, while a depressed portion is disposed below a damper portion, a width adjustment guiding portion, which contacts an outer edge in a width direction of the continuous paper to guide a feed of the continuous paper, is disposed on a lower portion of the damper portion such that the lower end portion of the width adjustment guiding portion is positioned within the depressed portion.

37 Claims, 17 Drawing Sheets

PRINTER

TECHNICAL FIELD

The present invention relates a printer, for example, a printer having a label printing function that prints desired information, such as a character, a sign, a diagram, a barcode, or similar information, on a label or a similar printing medium.

BACKGROUND ART

A label printer is a printer having a function that, for example, while unwinding a rolled continuous paper to feed the continuous paper in a sheet-shape, prints desired information on a label of the continuous paper.

At a printing unit of this label printer, a thermal head portion, which prints on the label, and a platen roller portion, which feeds the continuous paper, are disposed in a mutually opposing state.

Between a paper sheet supply unit and the thermal head portion at the printing unit, a damper portion, which gives tension to the continuous paper, is installed. In a lower portion of this damper portion, a width adjustment guiding portion, which contacts a side edge in a width direction of the continuous paper to guide a feed of the continuous paper, is installed. Below this width adjustment guiding portion, a bottom surface of a printer chassis is formed in a flat-shape, and a lower end portion of the width adjustment guiding portion is terminated at the position without contacting this bottom surface.

It should be noted that, for example, JP63-88651U discloses, a technique for preventing a occurrence of paper jam caused by a curling of paper sheet in a paper sheet feeding mechanism.

SUMMARY OF INVENTION

Now, the printer has an operation, what is called, a back feeding, which feeds a continuous paper in a direction opposite to a printing direction to feed for printing, in order to adjust a position of the continuous paper or for a similar purpose.

This back feeding may cause the continuous paper to contact a bottom surface of a printer chassis, which leads to a slack. In this case, since the continuous paper is positioned below a lower end of a width adjustment guiding portion, this causes the continuous paper to deviate out of range determined by the width adjustment guiding portion. However, returning to a printing operation in this state causes the continuous paper to run on the width adjustment guiding portion, and to be fed in a state where a damper portion does not function. This results in a printing position displaced off from a planned position and a thinned printing density, and ends up with deteriorated printing quality. Especially in the case where a width of the continuous paper is short, the continuous paper often deviates from the width adjustment guiding portion. The rolled continuous paper loaded in a paper sheet supply unit may slack due to a fictitious force by rotation.

The present invention has been made in view of the above-described technical background, and it is an object of the present invention to provide a technique that ensures printing quality of the printer.

To solve the above-described problem, a printer according to a first aspect of the present invention includes: a printing unit that prints on a print medium in a middle of feeding a print medium along a printing direction, the print medium being supplied from a medium supply unit, and a guiding unit that includes a guiding piece at a lower side of an upstream of feed with respect to the printing unit in the printing direction. The guiding piece contacts at least one side edge of the print medium to guide a feed of the print medium. A depressed portion is formed on a part of a bottom surface within a printer chassis, and the guiding piece includes a part positioned within the depressed portion.

A printer according to a second aspect of the present invention includes, in the printer according to the above-described first aspect, a damper portion disposed between the printing unit and the medium supply unit to give tension to the print medium. The guiding unit is disposed on the damper portion.

In a printer according to a third aspect of the present invention in the printer according to the above-described second aspect, the damper portion includes an inner damper portion, and a position where the inner damper portion abuts on the print medium is positioned on a downstream in a feed direction in the printing direction of the print medium with respect to the position of the depressed portion.

According to the first aspect, in the back feeding or fictitious force of a rotation direction of the rolled continuous paper, because a lower end portion of the guiding piece is positioned below the print medium, the print medium does not deviate out of range determined by the guiding piece. In view of this, since, when returning to the printing operation, the print medium also does not run on the guiding piece, the printing quality of the printer can be ensured.

According to the second aspect, since, when returning from the back feeding to the printing operation, the print medium also does not run on the guiding piece, a function of the damper portion is not also damaged. In view of this, the printing quality of the printer can be ensured.

According to the third aspect, since it can be prevented that the print medium deviates out of range determined by the guiding piece, the printing quality of the printer can be ensured.

DESCRIPTION OF EMBODIMENTS

Figure 1:
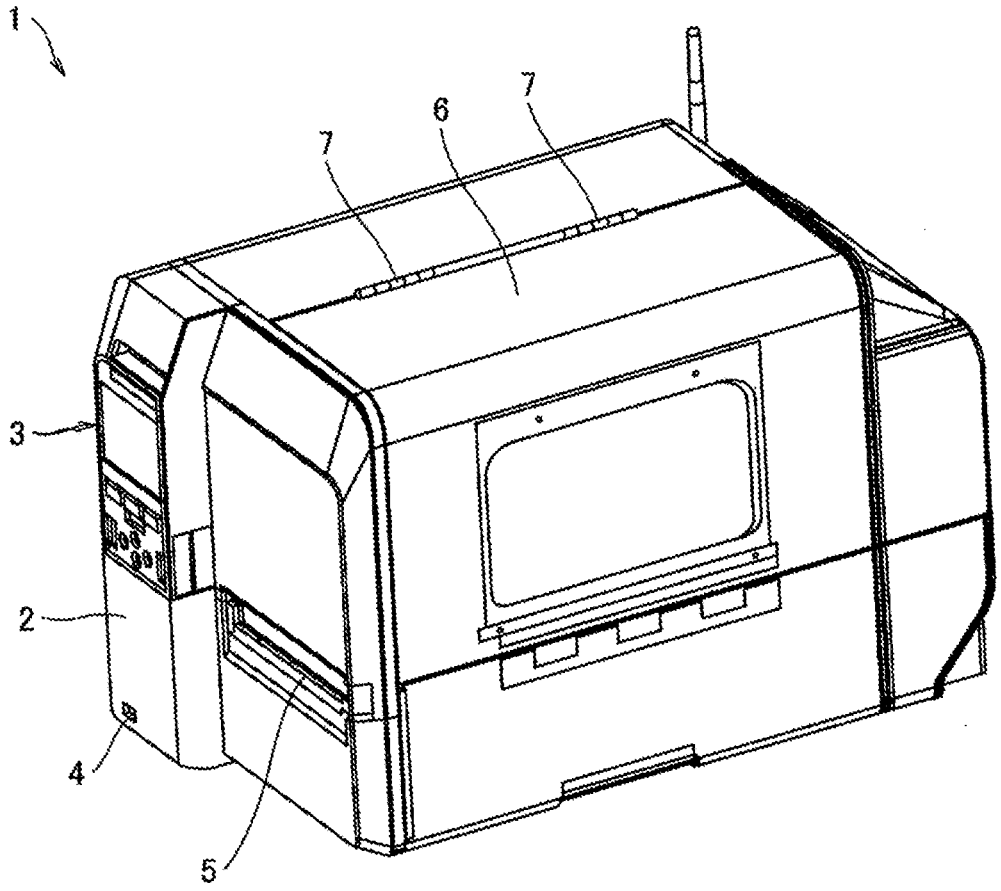
FIG. 1 is an overall perspective view of an appearance of a printer according to one embodiment of the present invention.

The following describes an embodiment as an example of the present invention in detail based on drawings. It should be noted that in the drawings to describe the embodiment, an identical reference numeral is basically attached to an identical component, and its repeated description is omitted.

A feed direction for printing a continuous paper (print medium), specifically a direction feeding the continuous paper from a paper sheet supply unit to a thermal head portion, is referred to as a printing direction, and if there is no specific description, an upstream in the feed direction is referred to as an upstream side in the printing direction, and the downstream in the feed direction is referred to as a downstream side in the printing direction.

FIG. 1 is an overall perspective view of an appearance of a printer according to the embodiment.

A printer 1 according to the embodiment has, for example, a label printing function, which prints information such as a character, a sign, a, diagram, a barcode, or similar information, on a label adhered temporarily on a liner sheet.

On a front cover portion 2 at a front of the printer 1, an operational panel unit 3, a power switch 4, and an issue port (medium discharge port) 5 are disposed.

On the operational panel unit 3, an LCD (liquid crystal display), which displays a message or similar information, a plurality of keys (line key, feed key, function key, direction indicating key, cancel key, and similar key), which operate an operation of the printer 1, and a plurality of LEDs (Light Emitting Diodes), which indicate a state of the printer 1, are disposed.

On one side surface of the printer 1, an open cover portion 6 is mounted in an openable/closable state in a vertical direction by hinge portions 7 at two sites.

Figure 2:
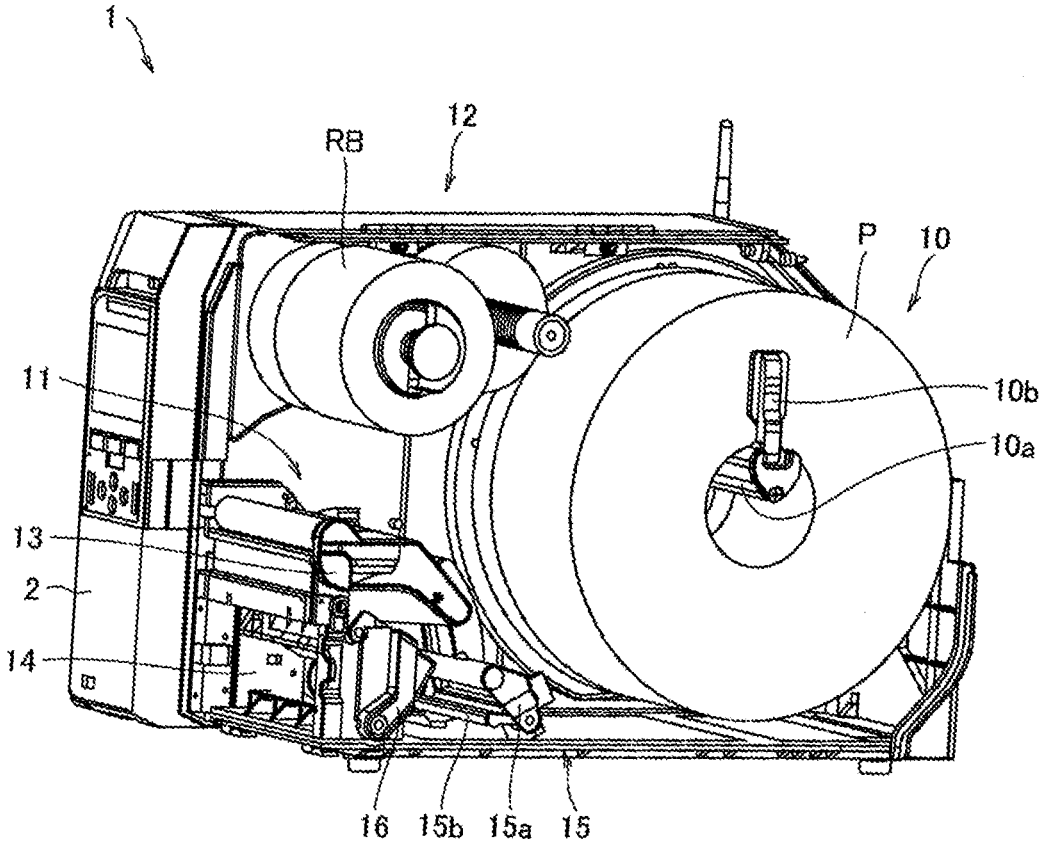
FIG. 2 is a perspective view for illustrating an inside of the printer in FIG. 1.
Figure 3:
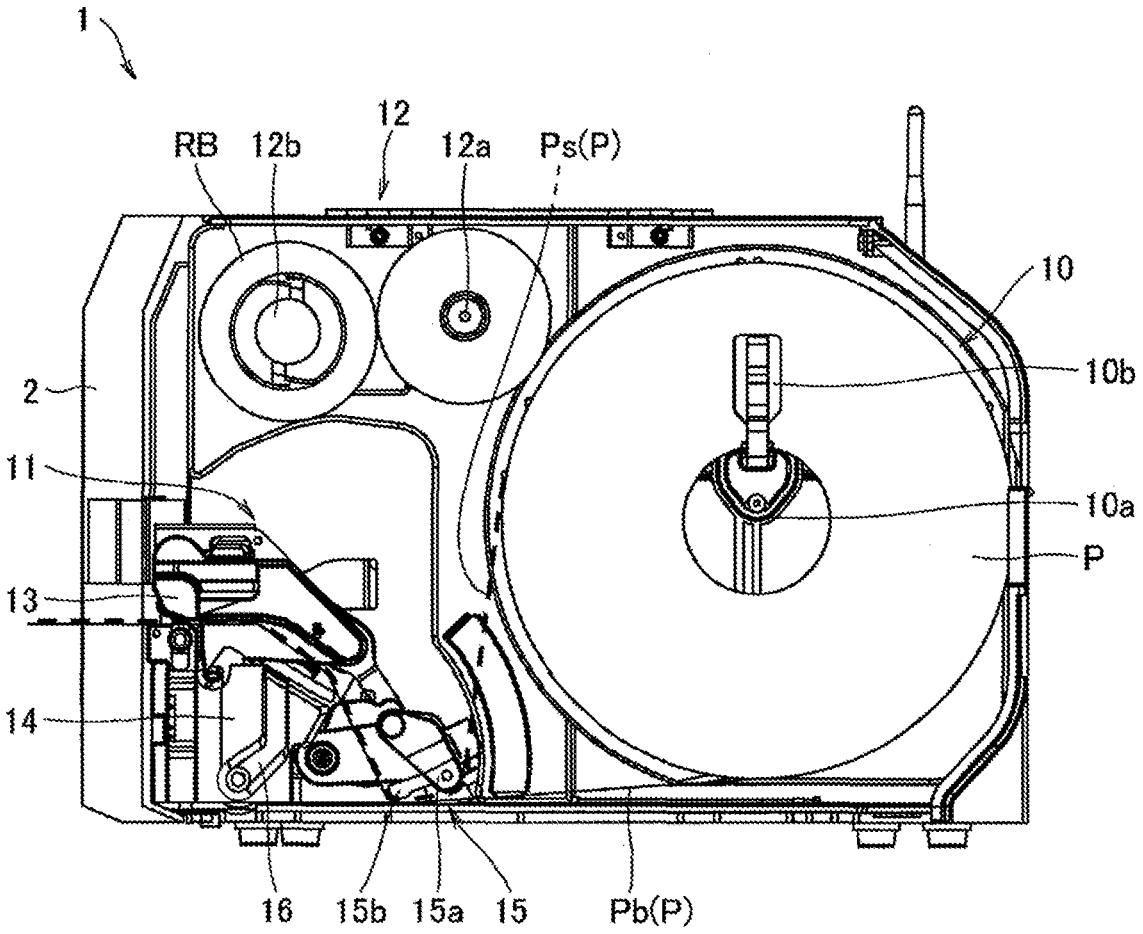
FIG. 3 is a perspective view for illustrating a side surface of the printer in FIG. 2.

Next, an internal structure of the printer 1 will be described in reference to FIG. 2 and FIG. 3. FIG. 2 is a perspective view for illustrating an inside of the printer in FIG. 1, and FIG. 3 is a perspective view for illustrating a side surface of the printer in FIG. 2. It should be noted that in the following description, a front side of the printer 1 (front cover portion 2 side) is referred to as a front (at a downstream side in the feed direction), and its opposite side, a back side (back cover portion side) is referred to as a rear (at an upstream side in the feed direction).

Inside the printer 1, a paper sheet supply unit (medium supply unit) 10, which is disposed on its rear side, a printing unit 11, which is disposed on its front side, and an ink ribbon portion 12, which is disposed on its upper side, are installed.

The paper sheet supply unit 10, which is a configuration unit that supplies a continuous paper (print medium) P to the printing unit 11, includes a support shaft 10*a* and a roll guiding portion 10*b*, which is installed at one end of the support shaft 10*a*.

The support shaft 10*a* is a configuration portion that rotatably supports the continuous paper P rolled up in a rolled shape. The roll guiding portion 10*b*, which is a configuration portion that fixes the rolled continuous paper P, is movably installed along an axial direction of the support shaft 10*a* to be able to change its position corresponding to a width of the continuous paper P.

The continuous paper P includes, for example, a long liner sheet and a plurality of labels adhered temporarily at every predetermined interval along a longitudinal direction of the liner sheet. On a surface where an adhesive surface of the label contacts on the liner sheet, a releasing agent such as silicone or similar material is coated, and this ensures the label to be peeled off easily. On a surface where the label is not applied on the liner sheet, position detection marks, which indicate a position of the label, are formed at every predetermined interval along the longitudinal direction. For the label, there is a case where a thermal paper is used and a case where a plain paper is used. In the case of the thermal paper, on its surface, a thermal coloring layer, which develops a specific color (such as black or red) when reaching a predetermined temperature region, is formed.

There are two types of continuous papers P: an outside wound label and an inside wound label. The outside wound label is wound in a state where the label of the continuous paper P is positioned on an outer peripheral surface of the rolled continuous paper P, and as shown in FIG. 3, a continuous paper Ps (P: dashed line) is unwound from around the center in the height direction of the paper sheet supply unit 10 toward a bottom portion of the printing unit 11. In contrast, the inside wound label is wound in a state where the label of the continuous paper P is positioned on an inner peripheral surface of the rolled continuous paper P, and as shown in FIG. 3, a continuous paper Pb (P: solid line) is unwound from around an internal bottom surface of the printer 1 toward the bottom portion of the printing unit 11. It should be noted that for both outside wound and inside wound, paper passing routes of the continuous paper P (Ps, Pb) in the printing unit 11 are identical. For both outside wound label and inside wound label, the continuous paper P is fed in a state where a surface where the label is temporarily adhered (printed surface) is upward.

The above-described printing unit 11, which is a configuration unit that prints on the label of continuous paper P or a similar print medium, includes a printing head portion 13. A supporting stand 14 is disposed below the printing head portion 13. A damper portion 15 is disposed upstream of the printing head portion 13 and the supporting stand 14 in the printing direction.

The printing head portion 13 is, as described below, installed inside the printer 1 in an openable/closable state. When the printing head portion 13 is in a closed state, between the printing head portion 13 and the supporting stand 14, the paper passing route (medium feed path) is formed. Then, this paper passing route is coupled to the above-described issue port 5 (see FIG. 1).

On the supporting stand 14, a head lock lever portion 16, which maintains the closed state of the printing head portion 13, is installed. Operating this head lock lever portion 16 releases the closed state of the printing head portion 13 and then a front portion of the printing head portion 13 is lifted to open the printing head portion 13 (the printing head portion 13 separates from a later-described platen roller portion).

The damper portion 15 is a configuration portion that gives tension to the continuous paper P. According to the embodiment, the damper portion 15, which includes an outer damper portion 15*a* and an inner damper portion 15*b*, moves in the vertical direction (opens and closes) in conjunction with an opening and closing of the printing head portion 13. However, in the closed state of the printing head portion 13, the outer damper portion 15*a* and the inner damper portion 15*b* are swingably installed such that each can give tension to the continuous paper P.

The above-described ink ribbon portion 12, which is a configuration portion that supplies and rolls up an ink ribbon RB where printing ink is applied, includes a ribbon supply unit 12*a* and a ribbon roll up unit 12*b*, which is disposed on a lateral of a front of the ribbon supply unit 12*a*. The ribbon supply unit 12*a* is a configuration unit that rotatably supports the ink ribbon RB rolled up in a rolled-shape. The ribbon roll up unit 12*b* is a configuration unit that rolls up and recovers the already printed ink ribbon RB. It should be noted that when using the ink ribbon RB, the ink ribbon extracted from the ribbon supply unit 12*a* is passed through below the printing head portion 13, and then rolled up by the ribbon roll up unit 12*b*.

According to such printer 1, the continuous paper P (Ps, Pb), which is unwound from the paper sheet supply unit 10 in a sheet-shape, is inserted into the paper passing route between the printing head portion 13 and the supporting stand 14 via the damper portion 15, and in the middle of this, after a printing processing is executed on the label of the continuous paper P or a similar print medium, is discharged outside the printer 1 from the issue port 5.

Figure 4:
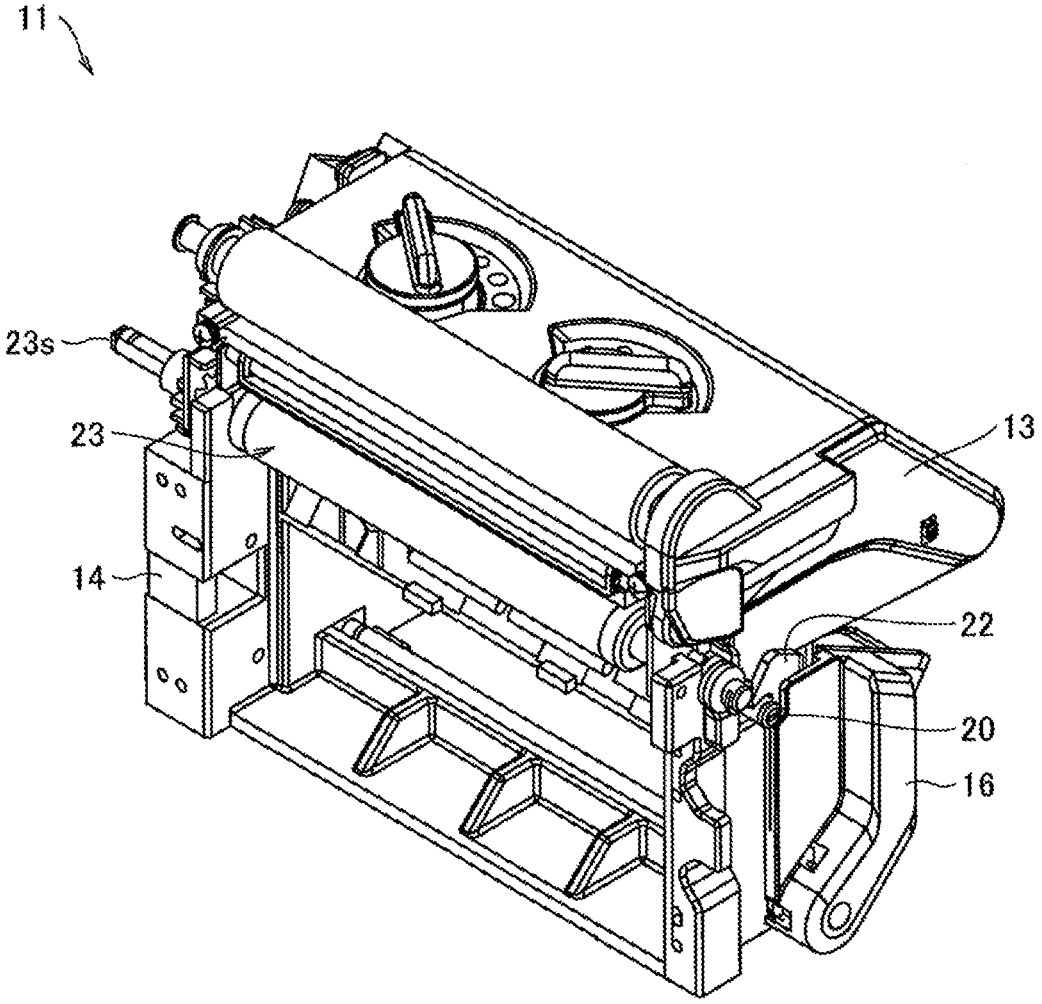
FIG. 4 is an enlarged perspective view where a printing unit in FIG. 3 is viewed from a front side.
Figure 5:
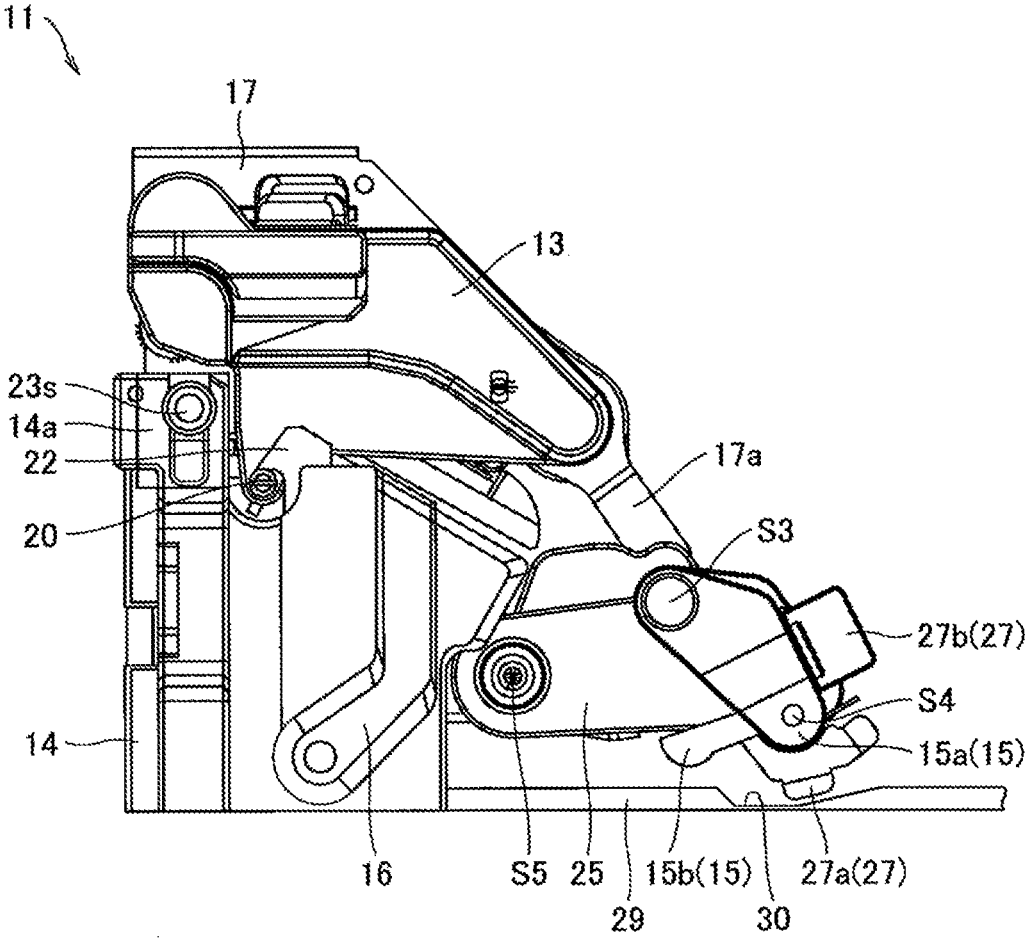
FIG. 5 is a side view of the printing unit in FIG. 4.
Figure 6:
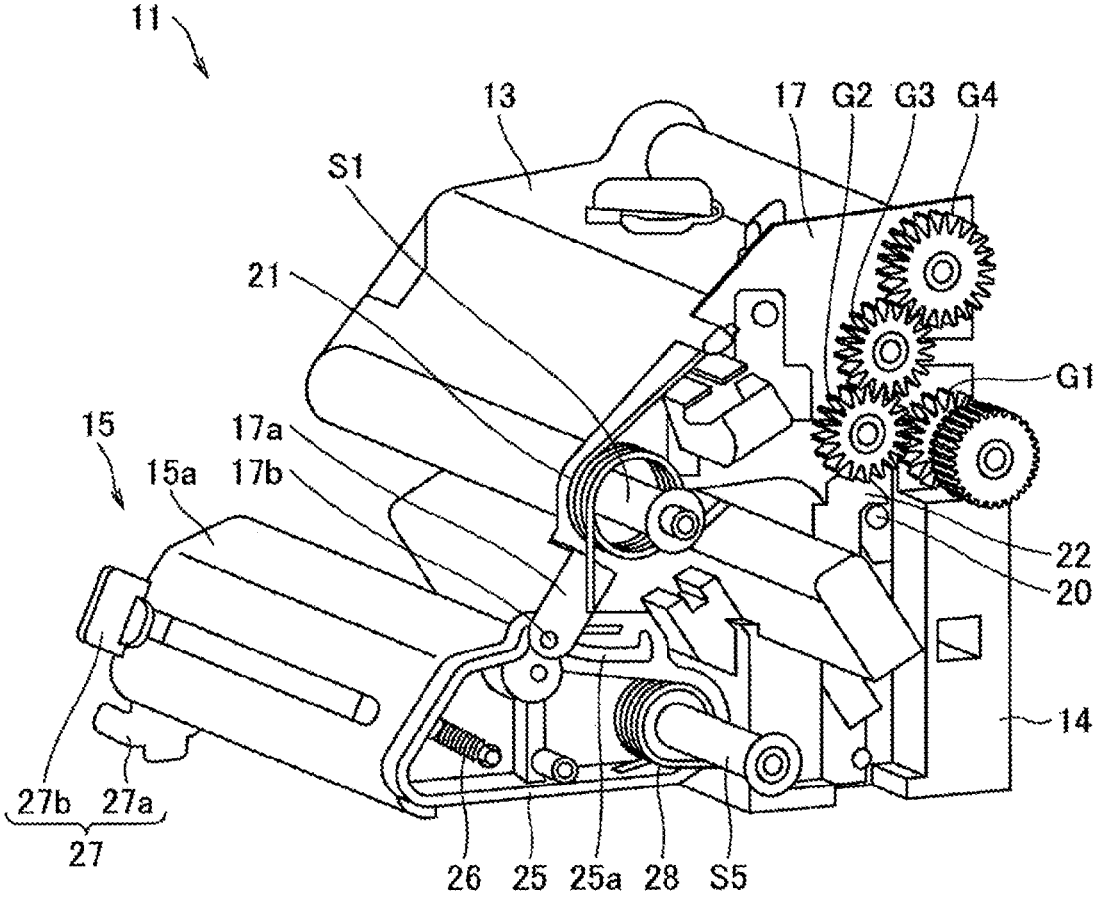
FIG. 6 is a perspective view where the printing unit in FIG. 4 is viewed from a back side.
Figure 7A:
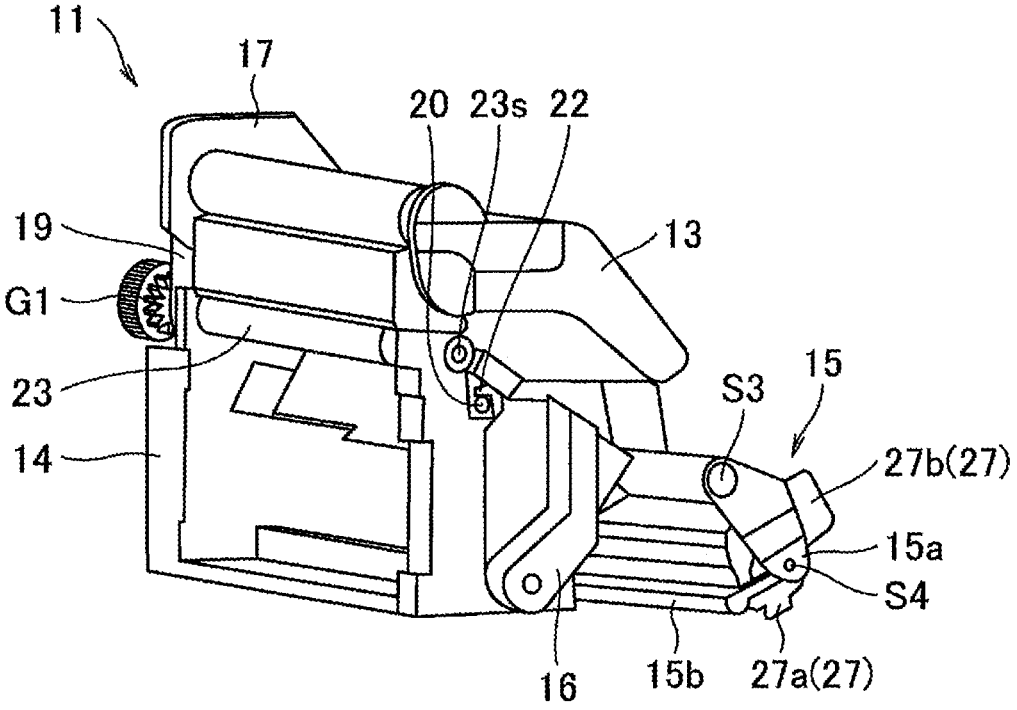
FIG. 7A is a perspective view where the printing unit in a closed state of a printing head unit in FIG. 4 is viewed from a front.

Next, a configuration of the above-described printing unit 11 will be described with reference to FIG. 4 to FIG. 9. FIG. 4 is an enlarged perspective view where the printing unit in FIG. 3 is viewed from a front side, FIG. 5 is a side view of the printing unit in FIG. 4, FIG. 6 is a perspective view where the printing unit in FIG. 4 is viewed from a back side, FIG. 7A is a perspective view where the printing unit in a closed state of a printing head portion in FIG. 4 is viewed from a front, FIG. 7B is a perspective view where the printing unit in an open state of the printing head portion in FIG. 4 is viewed from the front, FIG. 8 is a perspective view where the printing head portion in FIG. 4 is extracted, and then viewed from a lower side, and FIG. 9 is an exploded perspective view of the printing unit in FIG. 4.

The printing head portion 13, which constitutes the printing unit 11, is supported by a head support plate 17 of one side surface of the printing head portion 13. The head support plate 17 is swingably journaled around a rotary shaft S1 (see FIG. 6 and FIG. 8). Thus, a front portion of the printing head portion 13 is swingably supported (that is, openable/closable) in the vertical direction around the rotary shaft S1 of a rear of the printing head portion 13.

On the head support plate 17, a suppression portion 17*a* (see FIG. 5, FIG. 6, and FIG. 8) is formed integrally with an end portion of a side of the damper portion 15 (opposite end of the front portion of the head support plate 17 with respect to the rotary shaft S1). On a surface facing the damper portion 15 on a distal end of this suppression portion 17*a*, a pin 17*b* (see FIG. 6 and FIG. 8), which projects from its surface, is disposed.

Figure 7B:
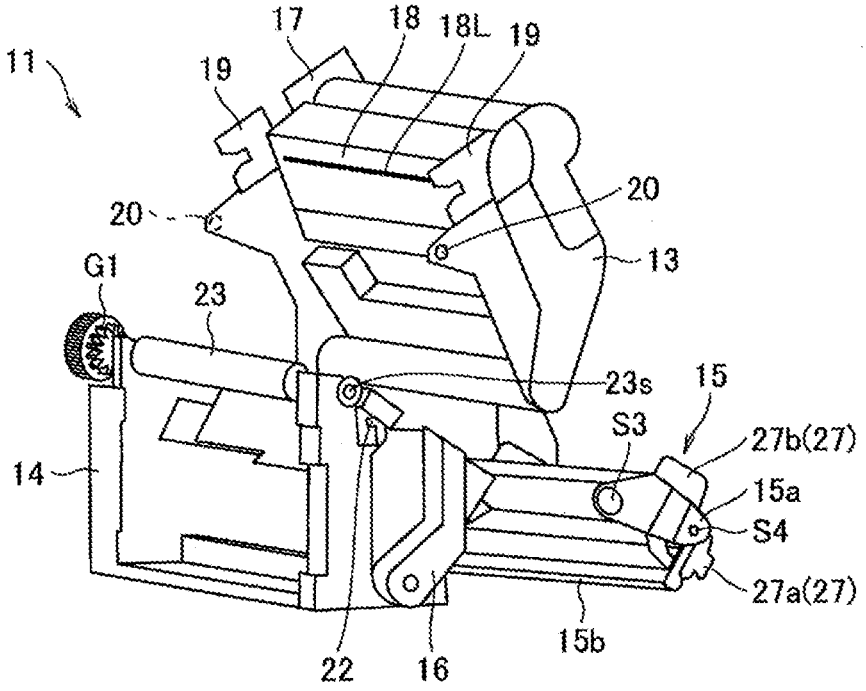
FIG. 7B is a perspective view where the printing unit in an open state of the printing head portion in FIG. 4 is viewed from the front.
Figure 8:
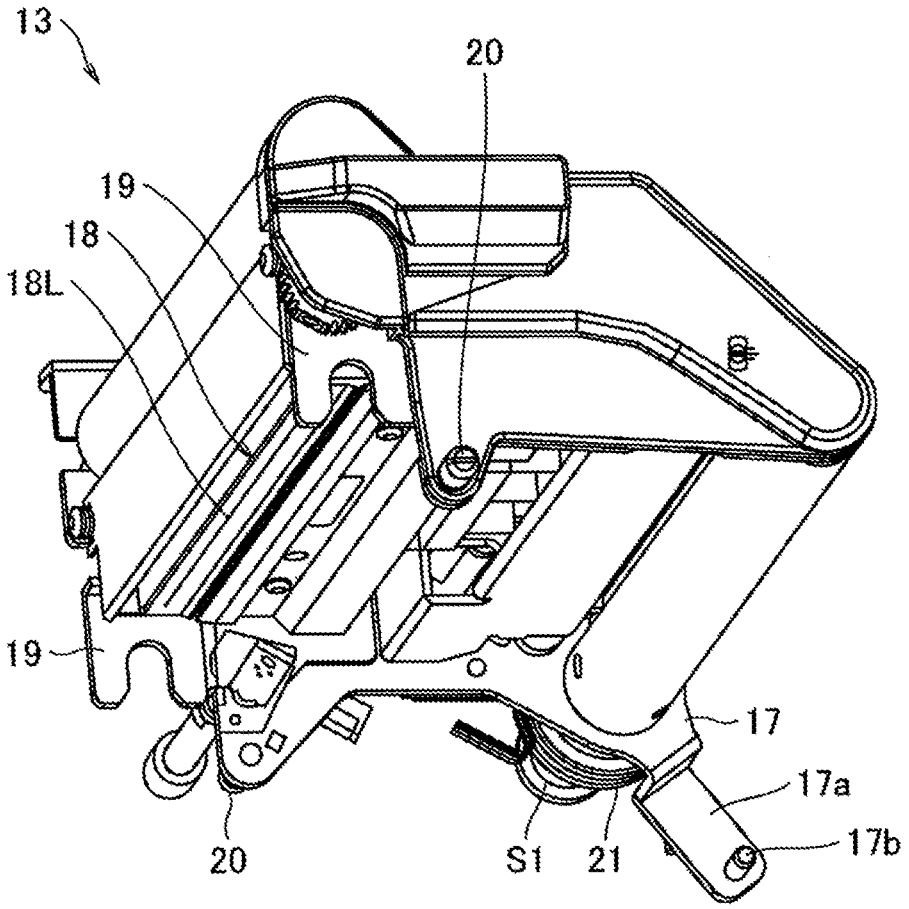
FIG. 8 is a perspective view where the printing head portion in FIG. 4 is extracted, and then viewed from a lower side.
Figure 9:
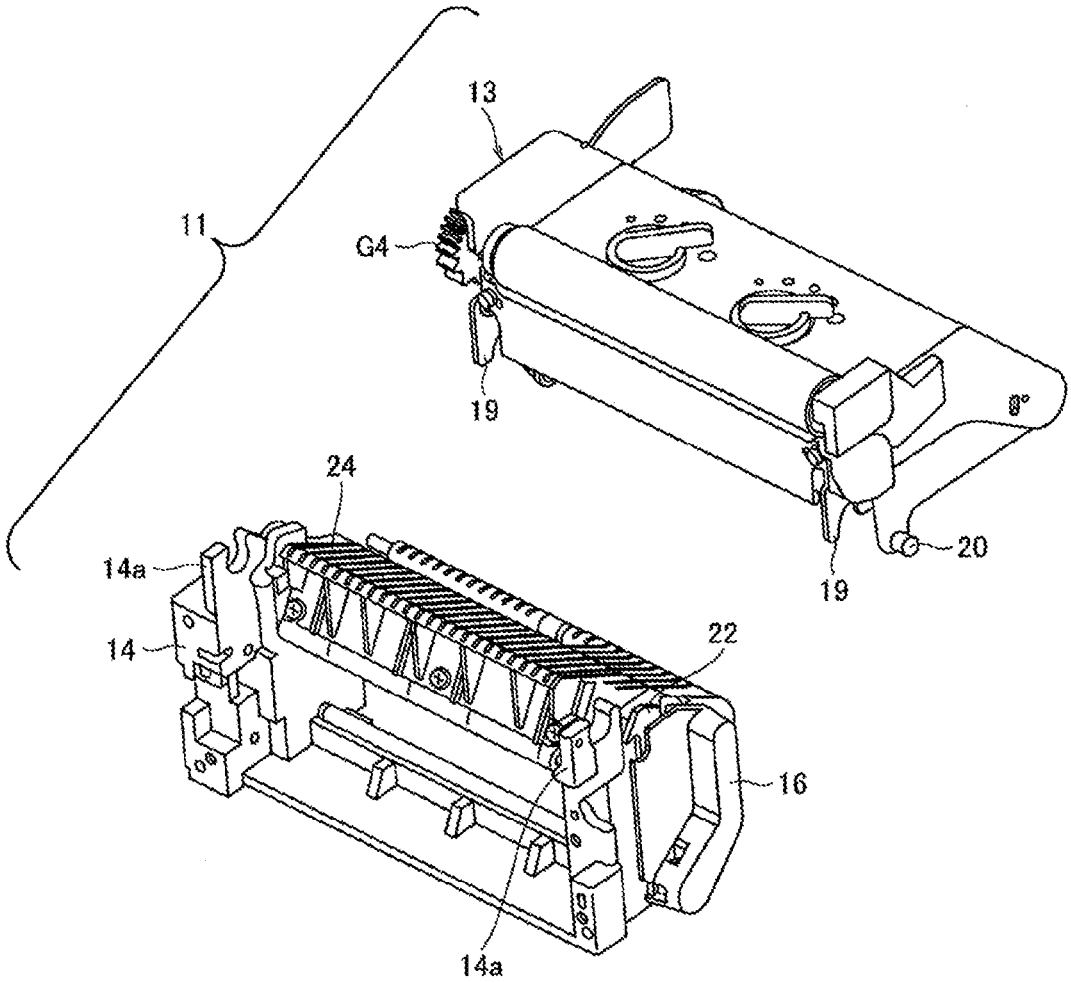
FIG. 9 is an exploded perspective view of the printing unit in FIG. 4.

The printing head portion 13 includes a thermal head portion 18 (see FIG. 7B and FIG. 8). The thermal head portion 18, which is the printing unit that prints on the label of the continuous paper P and similar print medium with heating resistors of a printing line 18L disposed on a printing surface of the thermal head portion 18. The thermal head portion 18 is installed on an inferior surface of the printing head portion 13 in a state where its printing surface faces the paper passing route. On the printing line 18L, a plurality of heating resistors (heating elements), which generates heat by energization, are arranged along a width direction (direction perpendicular to the feed direction of the continuous paper P) of the continuous paper P.

On an inferior surface of a front side of the printing head portion 13, depressed claw portions 19, 19 (see FIG. 7B and FIG. 8) are disposed so as to sandwich the thermal head portion 18. On the inferior surface of the printing head portion 13, pins 20, 20, which project outward from both side surfaces of the printing head portion 13, are disposed on a rear of the depressed claw portion 19.

While such printing head portion 13 is biased in the opening direction by a torsion spring 21 mounted on the rotary shaft S1 (see FIG. 6 and FIG. 8), the printing head portion 13 is maintained to be in a closed state with the lock claw portions 22, 22 of the supporting stand 14 being hooked in the pins 20, 20 on a lower portion of the printing head portion 13. Pulling the above-described head lock lever portion 16 rightward in FIG. 5 moves the lock claw portion 22 rightward in FIG. 5 along with this, thus unhooking the lock claw portion 22 from the pin 20. Unhooking the lock claw portion 22 from the pin 20, as shown in FIG. 7B, automatically opens the printing head portion 13 by biasing force of the torsion spring 21.

In the closed state of the printing head portion 13, while the depressed claw portions 19, 19 of the printing head portion 13 (see FIG. 7B and FIG. 8) are fitted on both end portions of a platen shaft 23*s* of a platen roller portion 23 (see FIG. 4, FIG. 7A, FIG. 7B, and FIG. 5), a printing surface of the thermal head portion 18 are pressed on the platen roller portion 23 (see FIG. 4, FIG. 7A, and FIG. 7B), which is below the thermal head portion 18, by a pressing device disposed on the printing head portion 13.

The platen roller portion 23, which is a feeding unit that feeds the continuous paper P unwound from the paper sheet supply unit 10 to the issue port 5 (see FIG. 1) along the paper passing route, is rotatably journaled to a supporting frame 14*a* of the supporting stand 14 (see FIG. 5 and FIG. 9) in a normal and reverse directions.

To one end in an axial direction of the platen shaft 23*s* of the platen roller portion 23, a gear G1 (see FIG. 6) is coupled. The platen shaft 23*s* of this gear G1 side, for example, is engaged with a rotary shaft of a driver (not illustrated) such as a stepping motor via such as a timing belt (not illustrated). The gear G1 is coupled to a gear G4 via a concatenation gears G2 and G3 (see FIG. 6).

On a top surface of the supporting stand 14, a paper sheet guiding portion (see FIG. 9) 24, which guides the feed of the continuous paper P, is installed at an upstream of feed with respect to the platen roller portion 23. This paper sheet guiding portion 24 is installed in an inclined state where a height at its top surface increases from the upstream of feed to a downstream of feed. On a top surface of the paper sheet guiding portion 24, protrusions, which extend along a feed direction of the continuous paper P, are disposed at every predetermined interval along a width direction of the continuous paper P. This ensures the reduced contact area of the paper sheet guiding portion 24 and the continuous paper P, thereby feeding the continuous paper P properly. This ensures the proper feed of even a continuous paper P, such as a label without a liner sheet where an adhesive is exposed or similar label. The protrusion on the top surface of the paper sheet guiding portion 24 is not limited to the protrusion that extends in the feed direction of the continuous paper P, but may be a point-like protrusion.

It should be noted that in the paper passing route of the printing unit 11, between the thermal head portion 18 and the damper portion 15, a paper-sheet-position detecting sensor (not illustrated) is disposed. This paper-sheet-position detecting sensor, which is a sensor that detects a label position of the continuous paper P by detecting the position detection mark disposed on the continuous paper P or a liner sheet part between adjacent labels, for example, is configured with a light reflection type or light transmission type sensor.

At the printing process, the continuous paper P is fed by rotating the platen roller portion 23 in a state where the thermal head portion 18 is pressed on a side of the platen roller portion 23, while the continuous paper P is sandwiched between the thermal head portion 18 and the platen roller portion 23. Then, based on information detected by the paper-sheet-position detecting sensor, a printing timing is determined, and the heating resistors of the printing line 18L are selectively heated by a printing signal transmitted to the thermal head portion 18. Thus, desired information, such as a character, a sign, a diagram, a barcode, or similar information, is printed on the label of the continuous paper P in the middle of feeding the continuous paper P.

Next, the damper portion 15, which constitutes the printing unit 11, will be described.

The outer damper portion 15*a*, when viewing a side surface of the printing unit 11, extends obliquely downward from a front side to a rear side, and is supported by a damper supporting member 25 around a rotary shaft S3 of the front side (see FIG. 5, FIG. 7A, and FIG. 7B) in a state where the rear portion is swingable in the vertical direction. It should be noted that a coil spring 26 in FIG. 6 is a member that inhibits the outer damper portion 15*a* from going excessively to an upper side (rear side), and swingably supports the outer damper portion 15*a*.

On the outer damper portion 15*a*, a guide mechanism portion (guide unit) 27 is disposed. The guide mechanism portion 27 includes a width adjustment guiding portion (guiding piece) 27*a* and a guide operating portion 27*b*. The width adjustment guiding portion 27*a*, which is a configuration portion abuts on one side edge of the width direction of the continuous paper P fed from the paper sheet supply unit 10, and guides the feed of the continuous paper P, is movably installed on a lower portion of the outer damper portion 15*a* along an axial direction of rotary shafts S3 and S4. On the other hand, the guide operating portion 27*b*, which is a tab for, while moving the width adjustment guiding portion 27*a* in accordance with the width of the continuous paper P, fixing a position of the width adjustment guiding portion 27*a*. The guide operating portion 27*b* is coupled to the width adjustment guiding portion 27*a*, and is movably installed on a back side of the outer damper portion 15*a* along the axial direction of the rotary shafts S3 and S4.

The damper supporting member 25, which supports such outer damper portion 15*a*, is supported within the printer 1 around a rotary shaft S5 of a front portion side (see FIG. 5 and FIG. 6) in a state where a rear portion is swingable in a vertical direction. On an upper portion of this damper supporting member 25, a long groove portion (induction portion) 25*a* (see FIG. 6), which extends along a longitudinal direction of the damper supporting member 25, is formed. To this long groove portion 25*a*, the pin 17*b* of the above-described head support plate 17 is movably fitted along the long groove portion 25*a*. Thus, the damper supporting member 25 is engaged with the head support plate 17. The damper supporting member 25, while its rear portion is biased in a direction opening upward (direction where the entire damper portion 15 rises) around the rotary shaft S5 (see FIG. 5 and FIG. 6) by a torsion spring 28 (see FIG. 6) mounted on the rotary shaft S5, is suppressed by the suppression portion 17*a*, and maintained to be in a closed state, during the suppression portion 17*a* of the head support plate 17 is positioned at a suppression position (outer damper portion 15*a* side). This configuration ensures the damper portion 15 to move in the vertical direction (open and close) in conjunction with the opening and closing of the printing head portion 13.

That is, opening the printing head portion 13 moves the suppression portion 17*a* along the long groove portion 25*a* from the suppression position (outer damper portion 15*a* side) to a suppression release position (rotary shaft S5 side). This results in the released suppression against an opening operation of the damper supporting member 25, thus raising the damper portion 15. This expands a width for inserting the continuous paper P, thus ensuring the improved visibility on a lower portion of the damper portion 15. In view of this, without hooking the continuous paper P extracted from the paper sheet supply unit 10 on a width adjustment guiding portion described below, the continuous paper P can be passed through easily below the damper portion 15. Accordingly, an operation inserting the continuous paper P into the paper passing route of the printer 1 can be facilitated. On the other hand, closing the printing head portion 13 moves the suppression portion 17*a* along the long groove portion 25*a* from the suppression release position to the suppression position, in conjunction with this, the damper portion 15 decreases in height to return to an original height. This can prevent the damper portion 15 from being failed to close. This can prevent a troubled printing on the continuous paper P in a state where tension is not given. This facilitates a sequence of insertion operations of the continuous paper P. Furthermore, since it is not necessary to dispose differently a mechanism portion to open manually the damper portion 15, and an opening mechanism portion and a closing mechanism portion of the damper portion 15 are doubled as one another, the structure can be simplified, and the number of components can be reduced. In view of this, a cost of the printer 1 can be reduced, and a downsizing of the printer 1 can proceed.

The above-described opening and closing mechanism of the damper portion 15 is not limited to the above-described configuration, may be configured, for example, as follows. That is, the damper supporting member 25 may be biased in a direction that its rear portion is closed around the rotary shaft S5 by the torsion spring 28 mounted on the rotary shaft S5 (direction where the entire damper portion 15 decreases in height). In this case, if the printing head portion 13 opens, as the suppression portion 17*a* moves along the long groove portion 25*a* from the suppression position to the suppression release position, the rear portion of the damper supporting member 25 is pulled to rise. Thus, the rear portion of the damper portion 15 opens in conjunction with an opening operation of the printing head portion 13. On the other hand, if the printing head portion 13 closes, as the suppression portion 17*a* moves along the long groove portion 25*a* from the suppression release position to the suppression position, the rear portion of the damper supporting member 25 decreases in height by an action of the torsion spring 28. Thus, the rear portion of the damper portion 15 closes in conjunction with a closing operation of the printing head portion 13. In this case, the biasing force of the torsion spring 21 on a side of the printing head portion 13 is configured to be larger than the biasing force of the torsion spring 28 on aside of the damper supporting member 25.

The inner damper portion 15*b*, which constitutes the above-described damper portion 15, when viewing the side surface of the printing unit 11, extends obliquely downward from the rear side to the front side in contrast to the outer damper portion 15*a*, and is supported by the rear portion of the outer damper portion 15*a* around the rotary shaft S4 (see FIG. 5, FIG. 7A, and FIG. 7B) on the rear side in a state where a front portion is swingable in the vertical direction.

At the printing process, a paper sheet contact portion of the inner damper portion 15*b* is positioned on the downstream of feed of the continuous paper P with respect to a paper sheet contact portion of the outer damper portion 15*a*. That is, the paper sheet contact portion of the inner damper portion 15*b* is disposed between the printing head portion 13 and the paper sheet contact portion of the outer damper portion 15*a*.

At a step before passing through the paper, a height of the paper sheet contact portion of the inner damper portion 15*b* is disposed at a lower position than a height of the paper sheet contact portion of the outer damper portion 15*a*. That is, the height of the paper sheet contact portion of the inner damper portion 15*b* is disposed between the paper sheet contact portion of the outer damper portion 15*a* and a bottom surface inside a chassis of the printer 1.

As such inner damper portion 15*b* is disposed, even a inside wound label is inserted into the paper passing route in a state where the continuous paper Pb contacts the inner damper portion 15*b*. In view of this, even in the case of the inside wound label, since the inner damper portion 15*b* can give enough tension to the continuous paper Pb, the continuous paper Pb can be fed properly to ensure printing quality.

As the inner damper portion 15*b* is journaled to the outer damper portion 15*a*, without enlarging the printer 1, a damper function that can give enough tension even in the case of the inside wound label can be added.

Figure 10A:
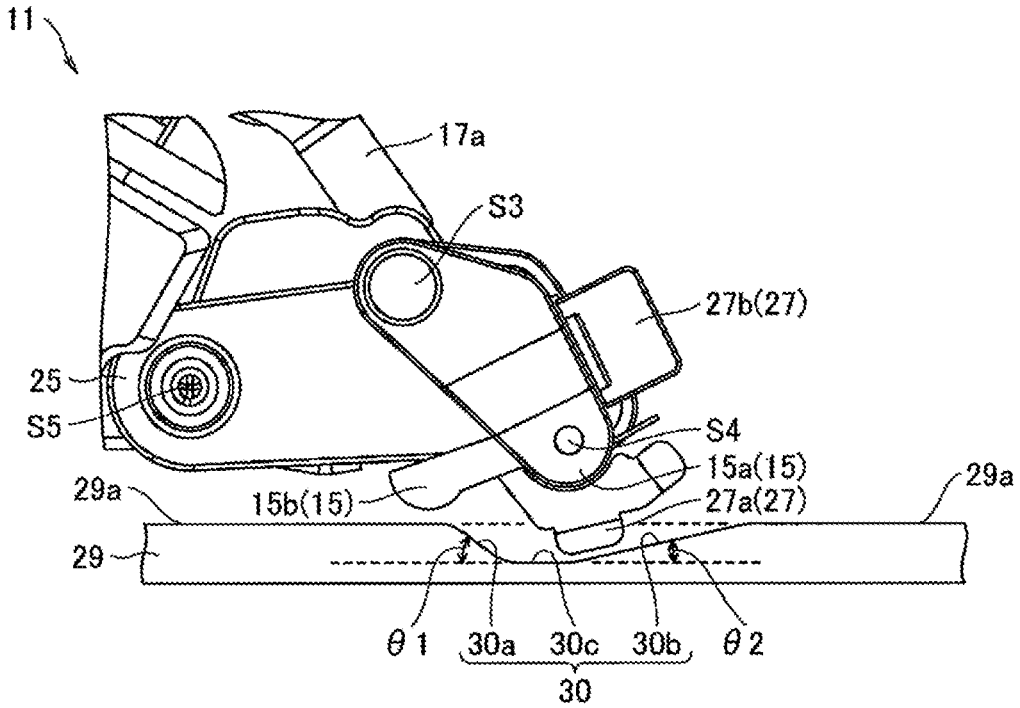
FIG. 10A is a main part enlarged side view of a damper portion in FIG. 5.
Figure 13:
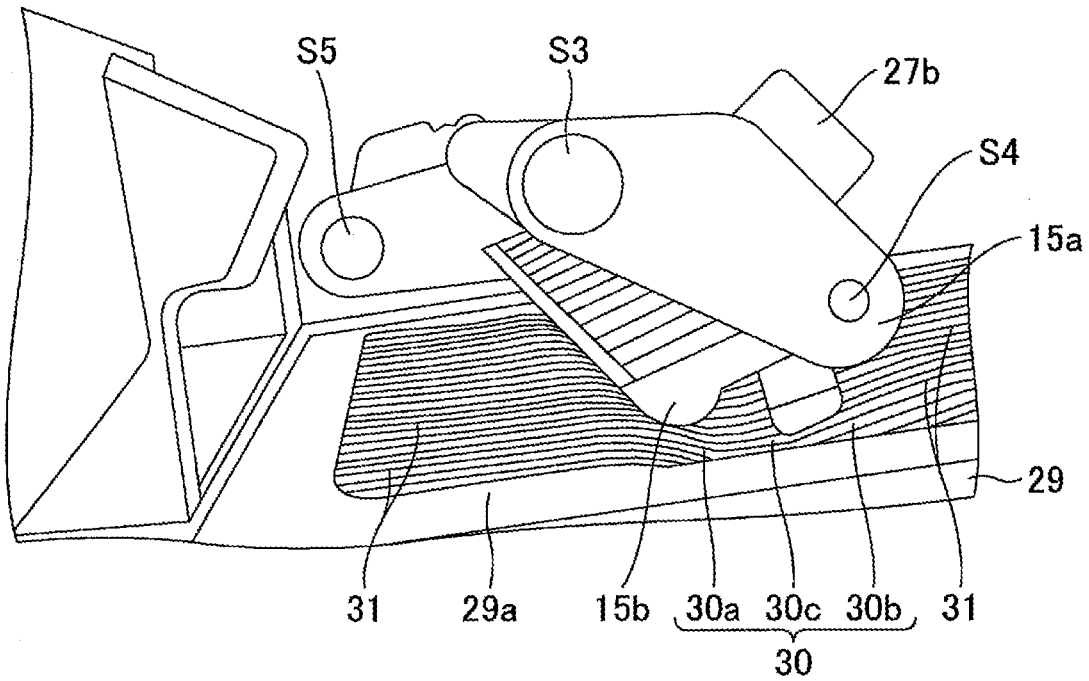
FIG. 13 is a main part perspective view of the damper portion in FIG. 10A and FIG. 10B.
Figure 14:
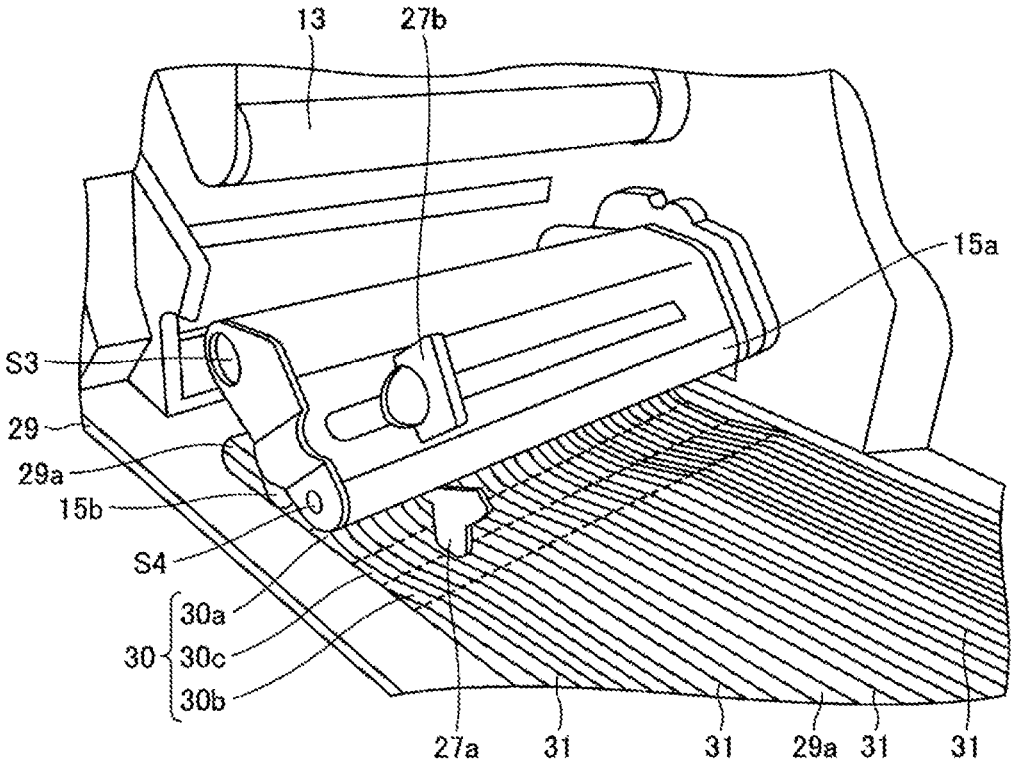
FIG. 14 is a main part perspective view of the damper portion and its peripheral where the printing unit is viewed from a back side.
Figure 15:
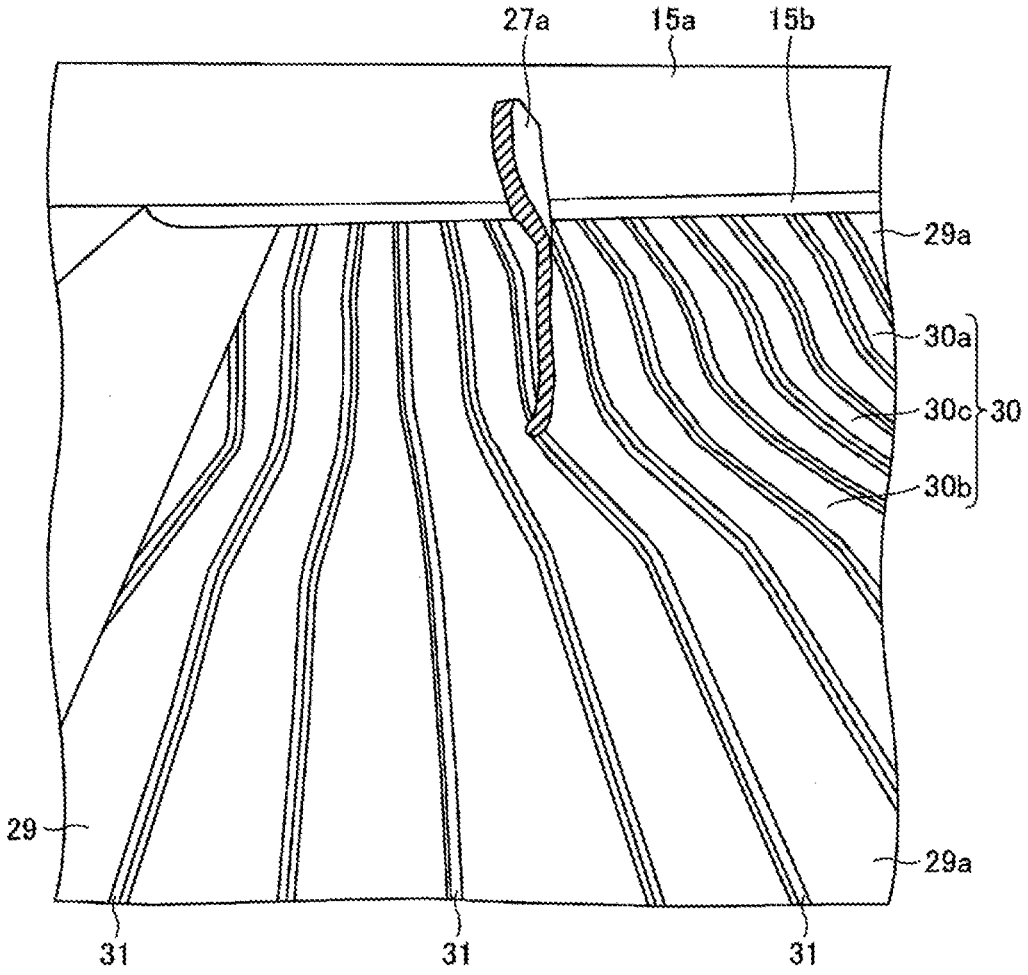
FIG. 15 is a main part enlarged perspective view of the damper portion and its peripheral where the printing unit is viewed from the back side.

Now, on the printer 1 according to the embodiment, a depressed portion 30 (see FIG. 5) is formed on a bottom portion 29 inside the chassis inside the printer 1 below the damper portion 15. Here, the depressed portion 30 and the width adjustment guiding portion 27*a* will be described with reference to FIG. 10A to FIG. 15. FIG. 10A is a main part enlarged side view of the damper portion in FIG. 5, FIG. 10B is a main part enlarged side view of the damper portion in FIG. 10A at the printing process, FIG. 11A is a main part enlarged side view of a damper portion of a comparative example at a back feeding process, FIG. 11B is a plan view where the damper portion in FIG. 11A is viewed from above, FIG. 12 is a main part enlarged side view of the damper portion in FIG. 10A at the back feeding process, FIG. 13 is a main part perspective view of the damper portion in FIG. 10A and FIG. 10B, FIG. 14 is a main part perspective view of the damper portion and its peripheral where the printing unit is viewed from the back side, and FIG. 15 is a main part enlarged perspective view of the damper portion and its peripheral where the printing unit is viewed from the back side.

Figure 10B:
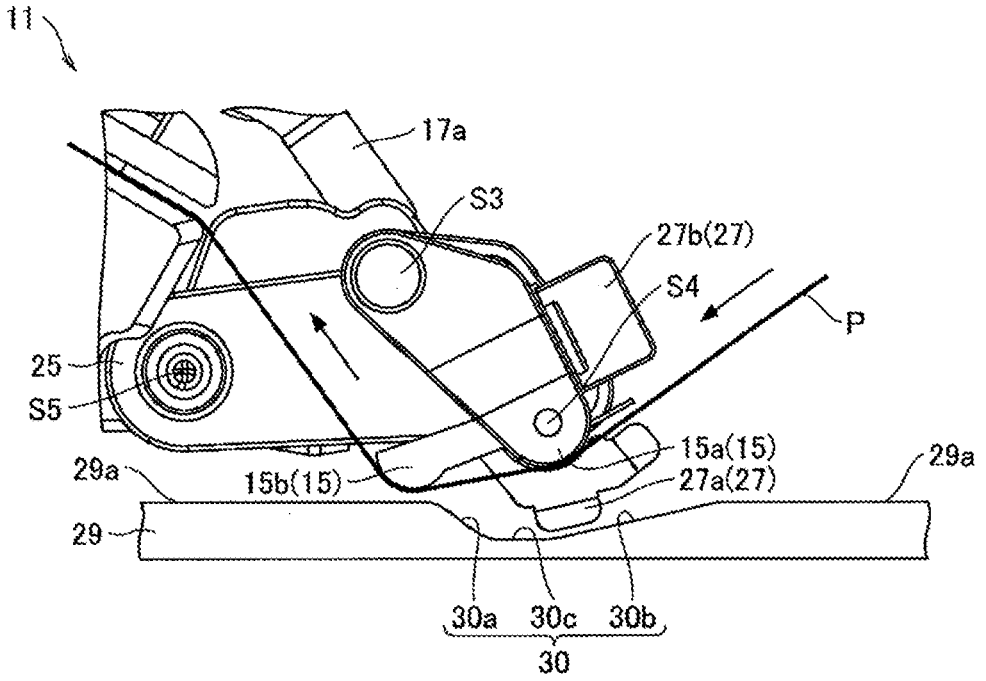
FIG. 10B is a main part enlarged side view of the damper portion in FIG. 10A at a printing process.
Figure 11A:
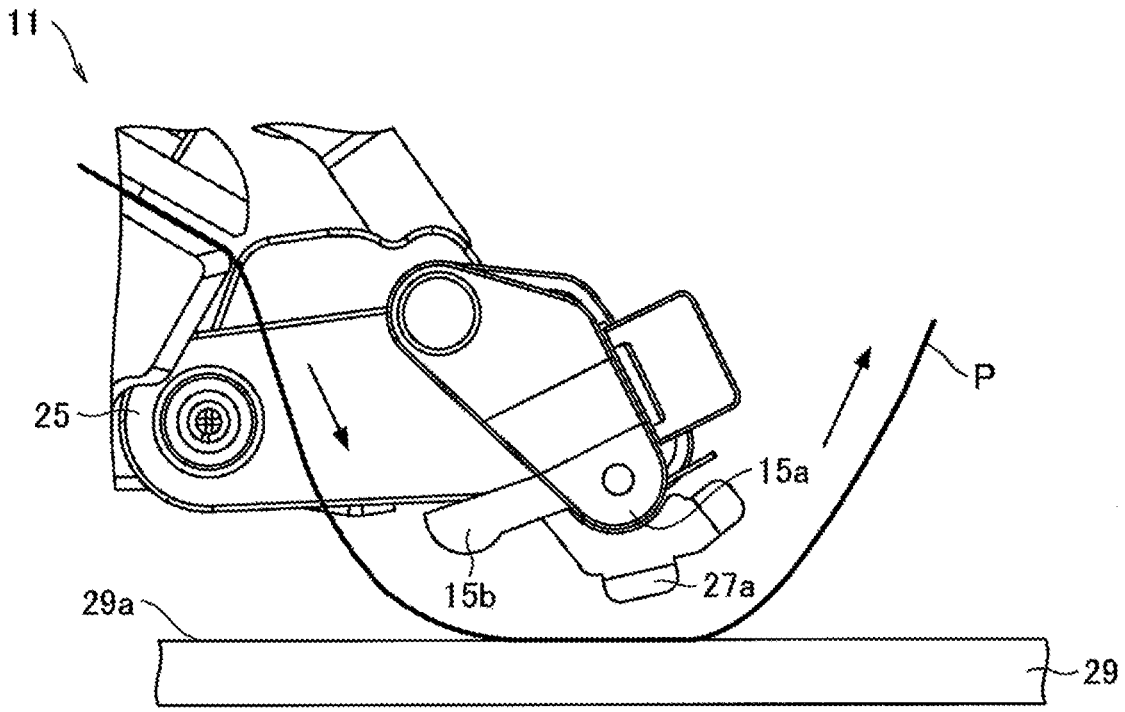
FIG. 11A is a main part enlarged side view of a damper portion of a comparative example at a back feeding process.
Figure 11B:
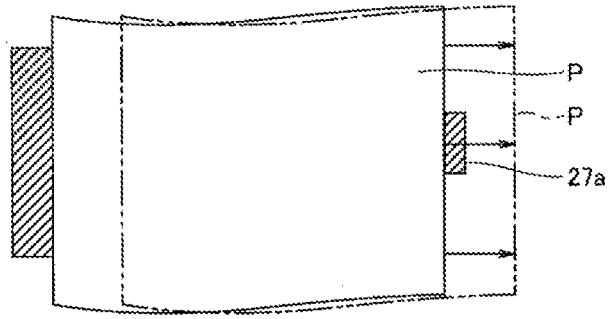
FIG. 11B is a plan view where the damper portion in FIG. 11A is viewed from above.

As shown in FIG. 10A and FIG. 10B, the depressed portion 30, which includes inner wall surfaces 30*a* and 30*b*, and a bottom surface 30*c* between the inner wall surfaces 30*a* and 30*b*, is formed such that a lower end portion of the width adjustment guiding portion 27*a* is positioned below a bottom surface 29*a* inside the chassis of the printer 1. That is, the depressed portion 30 is formed such that the inner wall surface (wall surface) 30*a*, which is disposed on the downstream of feed with respect to the width adjustment guiding portion 27*a*, is higher than the lower end portion of the width adjustment guiding portion 27*a*.

Here, the printer 1 has an operation, what is called, a back feeding, which feeds the continuous paper P in a direction opposite to the direction to feed for printing, in order to adjust a position of the continuous paper P or for a similar purpose. This back feeding may cause, as shown in FIG. 11A, the continuous paper P to contact the bottom surface 29*a* inside the chassis of the printer 1, which leads to a slack. In this case, since the continuous paper P is positioned below the lower end of the width adjustment guiding portion 27*a*, as illustrated by a two-dot chain line in FIG. 11B, this cause the continuous paper P to deviate out of range specified by the width adjustment guiding portion 27*a*. However, returning to a printing operation in this state causes the continuous paper P to run on the width adjustment guiding portion 27*a*, and to be fed in a state where the damper portion 15 does not function. This results in a printing position displaced off from a planned position, a thinned printing density, and ends up with deteriorated printing quality.

Figure 12:
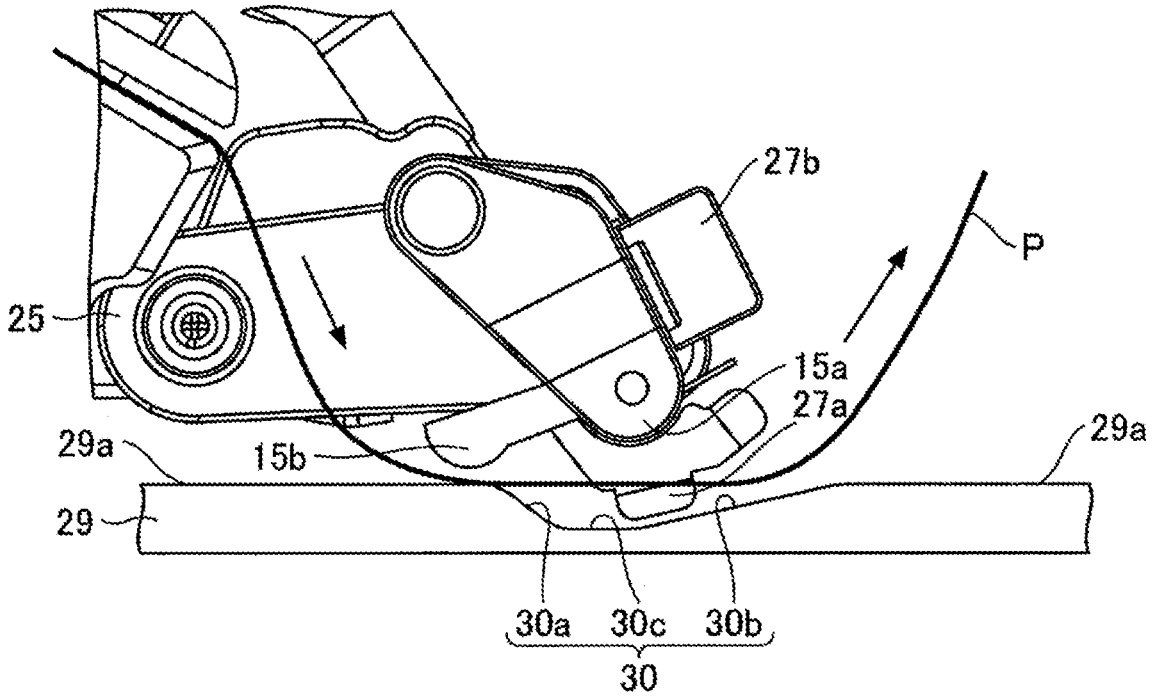
FIG. 12 is a main part enlarged side view of the damper portion in FIG. 10A at the back feeding process.

In contrast, according to the embodiment, as shown in FIG. 12, at the back feeding, even if the continuous paper P contacts the bottom surface 29*a* inside the chassis of the printer 1 and slacks, since the lower end portion of the width adjustment guiding portion 27*a* is positioned within the depressed portion 30, and is positioned below the bottom surface 29*a* inside the chassis of the printer 1, the continuous paper P does not deviate out of range determined by the width adjustment guiding portion 27*a*. In view of this, when returning to the printing operation, since the continuous paper P also does not run on the width adjustment guiding portion 27*a*, the function of the damper portion 15 is not also hindered. Accordingly, this avoids the trouble, such as the printing position displaced off from the planned position, and a thinned printing density, thus ensuring the printing quality of the printer 1.

From the above, a position of the depressed portion 30, within a surface of the bottom surface 29*a* inside the chassis of the printer 1, is positioned at an upstream side of feed with respect to a position where the continuous paper P contacts a ground at the back feeding, and the inner wall surface 30*a* of the depressed portion 30 may be positioned between the position where the continuous paper P contacts the ground at the back feeding and the width adjustment guiding portion 27*a*. According to the embodiment, a position where the inner damper portion 15*b* abuts on the continuous paper P is positioned on the downstream in the feed direction of the continuous paper P with respect to a position of the inner wall surface 30*a* of the depressed portion 30. In view of this, since the continuous paper P contacts the inner damper portion 15*b* at the back feeding, the continuous paper P contacts the ground of the bottom surface 29*a*, which is on the downstream of feed with respect to the depressed portion 30. As a result, the inner wall surface 30*a* of the depressed portion 30 is positioned between the position where the continuous paper P contacts the ground at the back feeding and the width adjustment guiding portion 27*a*.

The inner wall surface 30*a* at a downstream side of feed and the inner wall surface 30*b* at the upstream side of feed, of the depressed portion 30 are formed in an inclined state with respect to the bottom surface 29*a* inside the chassis of the printer. The inner wall surface 30*a* at the downstream side of feed is formed to rise gradually along the printing direction.

An inclination angle θ1 of the inner wall surface 30*a* at the downstream side of feed of the depressed portion 30 is larger than an inclination angle θ2 of the inner wall surface 30*b* at the upstream side of feed of the depressed portion 30 (θ1>θ2). This, as shown in FIG. 10B, corresponds to the fact that a flow of the continuous paper P at the printing process enters gradually from the upstream of feed of the damper portion 15, and then rises rapidly at the downstream side of feed of the damper portion 15. This ensures the proper feed of the continuous paper P. The wall surface is a part of a step portion formed on the bottom surface inside the chassis of the printer.

The lower end portion of the width adjustment guiding portion 27*a*, as shown in FIG. 10A, FIG. 10B, FIG. 15, and a similar drawing, is positioned within the depressed portion 30, but does not contact the bottom surface of the depressed portion 30, and is away from the bottom surface of the depressed portion 30 by a predetermined distance. This lower end portion of the width adjustment guiding portion 27*a*, for example, may be formed in an arc-shape.

The lower end portion of the width adjustment guiding portion 27*a*, as shown in FIG. 15, is bent outward in the width direction (direction separating from the continuous paper P: left side in FIG. 15) of the continuous paper P gradually to a lower distal end. This returns the continuous paper P, which moves outward in the width direction, to an original inward position in the width direction. It should be noted that, in FIG. 15, a part of the drawing is hatched in order to see easily the width adjustment guiding portion 27*a*. In FIG. 15, the continuous paper P is set on a right side of the width adjustment guiding portion 27*a*.

As shown in FIG. 13 to FIG. 15, on a part of the bottom surface 29*a* inside the chassis of the printer 1, on an inner surface (the inner wall surfaces 30*a* and 30*b*, and the bottom surface 30*c*) of the depressed portion 30, a plurality of protrusions 31, which extend along the feed direction of the continuous paper P, are disposed at every predetermined interval along the width direction of the continuous paper P. This can reduce a contacted area of the bottom surface 29*a* inside the chassis of the printer 1 (including the inner surface of the depressed portion 30) and the continuous paper P, thus feeding the continuous paper P properly. The continuous paper P, such as a label without a liner sheet where an adhesive is exposed or similar label, can be fed properly. Furthermore, although disposing the depressed portion 30 may deteriorate a mechanical strength of the bottom portion 29 inside the chassis of the printer 1, disposing the plurality of protrusions 31 ensures the mechanical strength of the bottom portion 29 inside the chassis of the printer 1.

Figure 16A:
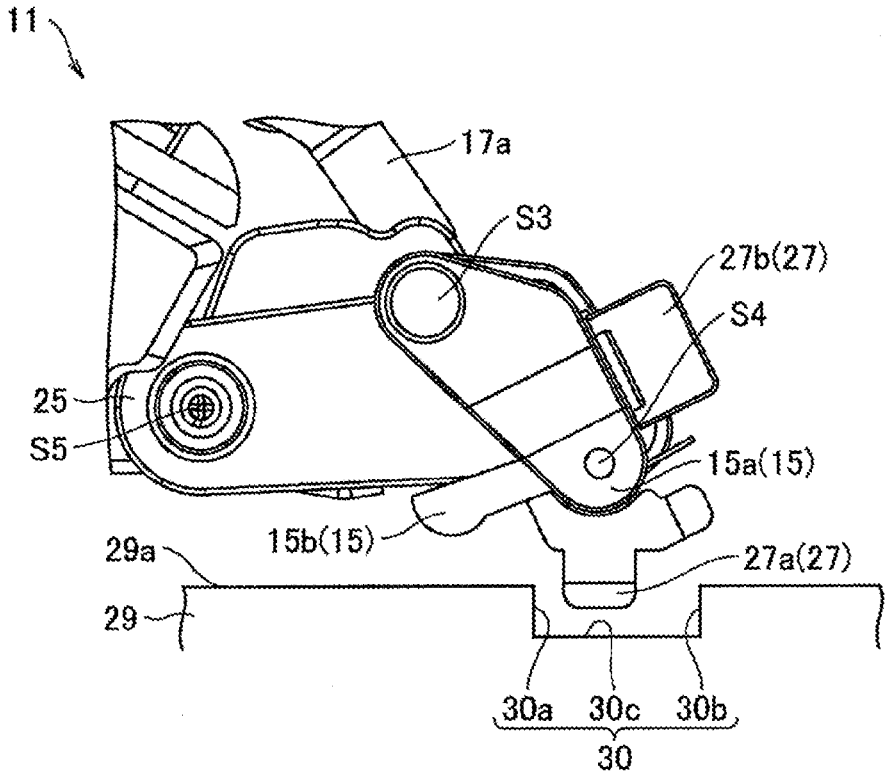
FIG. 16A is a main part enlarged side view of a damper portion of the printer.
Figure 16B:
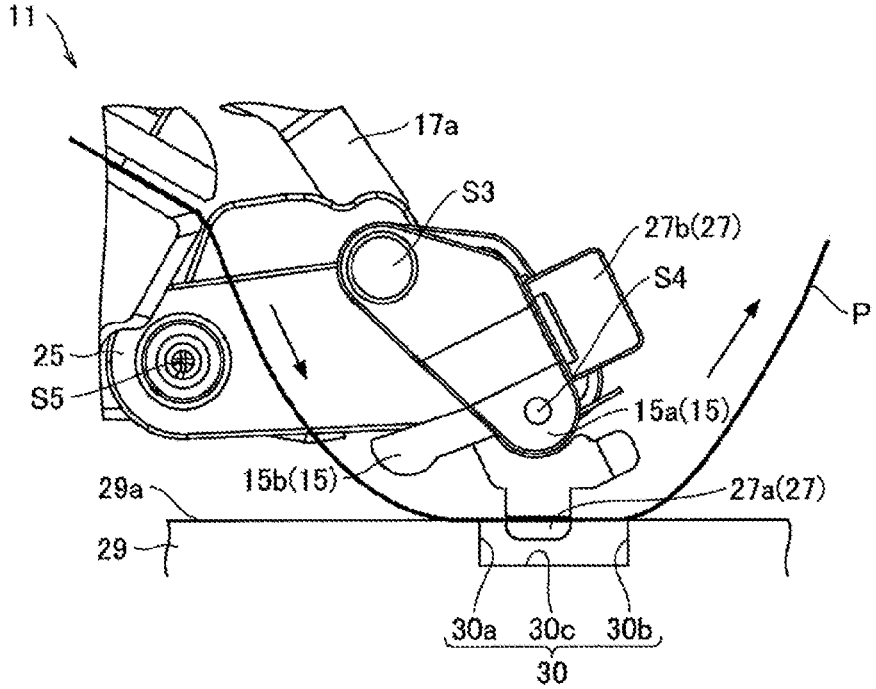
FIG. 16B is a main part side view of the damper portion in FIG. 16A at the back feeding process.

Next, a modification of the depressed portion 30 is shown in FIG. 16A and FIG. 16B. FIG. 16A is a main part enlarged side view of the damper portion of the printer, and FIG. 16B is a main part side view of the damper portion in FIG. 16A at the back feeding process.

In the above, a case where the inner wall surfaces 30*a* and 30*b* of the depressed portion 30 are inclined has been described. However, as shown in FIG. 16A and FIG. 16B, the inner wall surfaces of the depressed portion 30 are not inclined, and are formed approximately vertical to the bottom surface 29*a* inside the chassis of the printer 1. This case, as shown in FIG. 16B, can make the continuous paper P difficult to enter the depressed portion 30 at the back feeding process to prevent a position gap in the width direction of the continuous paper P. Except for this, the modification is identical to the above.

Figure 17A:
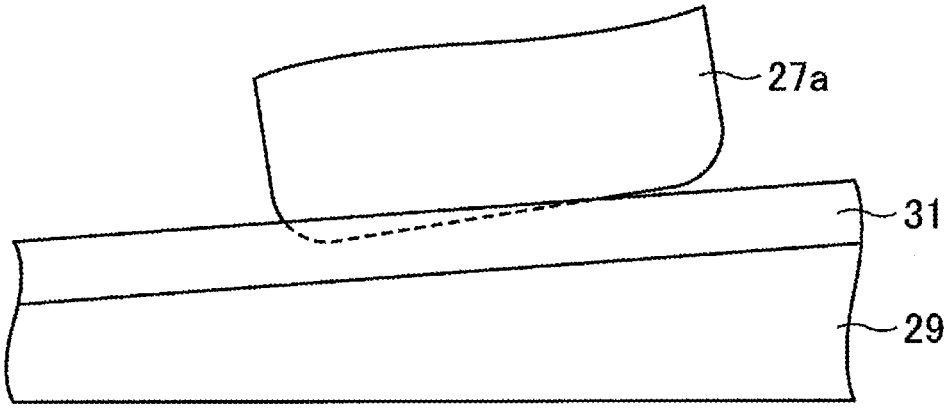
FIG. 17A is a main part enlarged side view of a width adjustment guiding portion and a bottom portion of a chassis, of the printer.
Figure 17B:
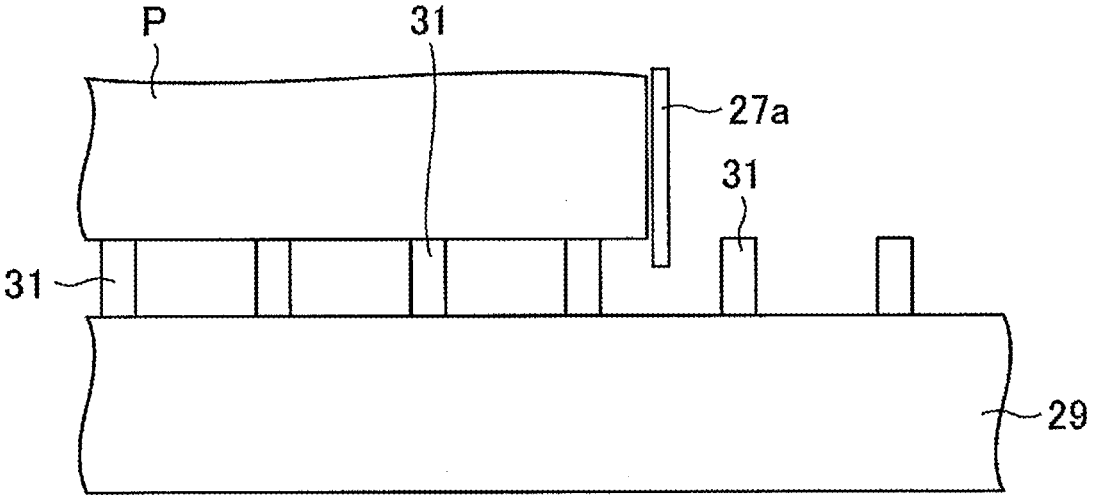
FIG. 17B is a main part enlarged front view where the width adjustment guiding portion and the bottom portion of the chassis, of the printer are viewed from an anterior surface side.

Next, an exemplary relationship between the width adjustment guiding portion 27*a* and the protrusion 31 is shown in FIG. 17A and FIG. 17B. FIG. 17A is a main part enlarged side view of the width adjustment guiding portion and the bottom portion of the chassis, of the printer, while FIG. 17B is a main part enlarged front view where the width adjustment guiding portion and the bottom portion of the chassis, of the printer are viewed from an anterior surface side.

Here, a bottom side of the width adjustment guiding portion 27*a* is positioned at a height between the bottom surface 29*a* of the chassis and the protrusion 31. Since a lower portion of the width adjustment guiding portion 27*a* is positioned below the position of the continuous paper P, this can prevent the position gap in the width direction of the continuous paper P at the back feeding or a similar process. Except for this, the exemplary relationship is identical to the above.

As described above, the invention made by the present inventor has been described specifically based on the embodiment. However, it should be understood that the embodiment disclosed herein is for illustrative purposes in all respects, and is not limited to the technique disclosed. That is, the technical scope of the present invention should not be construed in a restrictive manner based on the description in the embodiment, should be construed in accordance with the description in a range of the claim as a principle, and the technique identical to the technique disclosed in a range of the claim and all changes within the scope of the claim are included.

According to the embodiment, a case that a continuous paper, which includes a plurality of labels adhered temporarily on a liner sheet, is used as a print medium has been described, but this should not be construed in a limiting sense; for example, a continuous label including an adhesive surface on one surface (linerless label), a continuous sheet without an adhesive surface (continuous sheet), or, not limited to papers, a printable film by a thermal head or a similar film can be used as a print medium. The label without liner sheet, the continuous sheet, or the film can include a position detection mark. In the case where the label without liner sheet, where an adhesive is exposed, or a similar label is fed, a roller including silicone may be disposed while a non-adhesive coating is applied to a feed path.

In the above description, the present invention has been described in a case applying to a stand-alone type printer, where an input operation to the printer is executed without a personal computer, but this should not be construed in a limiting sense; for example, the present invention may also apply to an on-line type printer, where the input operation to the printer is executed via the personal computer.

This application claims the priority based on Patent Application No. 2013-268262 filed in the Japan Patent Office on Dec. 26, 2013, and every content of this application is incorporated herein by reference.

The invention claimed is:

1. A printer, comprising:

a feeding unit configured to feed a print medium;

a printing head portion configured to print on the print medium;

a guiding unit that includes a guiding portion disposed upstream of the printing head portion in a printing direction; and a depressed portion formed on a part of a bottom surface within a printer chassis, wherein the guiding unit, except the guiding portion, is arranged at a position away from the depressed portion, and a part of the guiding portion is positioned within the depressed portion.

2. The printer according to claim 1, further comprising:

a damper portion disposed between the printing head portion and the feeding unit to give tension to the print medium, wherein the guiding unit is disposed on the damper portion.

3. The printer according to claim 2, wherein the damper portion comprises an inner damper portion, wherein a position where the inner damper portion abuts on the print medium is positioned downstream in the printing direction of the print medium with respect to a position of the depressed portion.

4. The printer according to claim 1, wherein the guiding portion is away from a bottom surface of the depressed portion.

5. The printer according to claim 1, further comprising:

a damper portion configured to give tension to the print medium, wherein the damper portion is swingably installed.

6. The printer according to claim 1, further comprising:

a damper portion configured to give tension to the print medium, wherein the damper portion includes an outer damper portion and an inner damper portion, the inner damper portion is swingably supported on the outer damper portion.

7. The printer according to claim 6, wherein the guiding unit is disposed on the outer damper portion.

8. The printer according to claim 6, wherein the inner damper portion includes a paper sheet contact portion configured to contact the print medium, the paper sheet contact portion of the inner damper portion positioned downstream in the printing direction with respect to the depressed portion.

9. The printer according to claim 6, wherein the inner damper portion is supported on an upstream side of the outer damper portion with respect to the printing direction, the inner damper portion includes a paper sheet contact portion configured to contact the print medium, the outer damper portion includes a paper sheet contact portion configured to contact the print medium, and a height of the paper sheet contact portion of the inner damper portion is disposed at a lower position than a height of the paper sheet contact portion of the outer damper portion.

10. The printer according to claim 8, wherein the paper sheet contact portion of the inner damper portion is positioned downstream of a paper sheet contact portion of the outer damper portion with respect to the printing direction.

11. The printer according to claim 1, wherein the feeding unit is further configured to feed the print medium in a direction opposite to the printing direction.

12. The printer according to claim 1, wherein the depressed portion is formed on a part of the bottom surface within the printer chassis continuously to the bottom surface.

13. The printer according to claim 1, wherein the print medium includes a liner sheet and a plurality of labels temporarily adhered at predetermined intervals along a longitudinal direction of the liner sheet.

14. The printer according to claim 1, wherein the guiding portion includes a guiding piece, the guiding piece includes an inclined surface which increases from an upstream side towards a downstream side of the printing direction, and the guiding piece abuts one side edge of the print medium.

15. The printer according to claim 1, wherein a lower end portion of the guiding portion is positioned between the bottom surface of the printer chassis and a bottom surface of the depressed portion.

16. The printer according to claim 1, wherein the guiding unit is disposed at a height beneath the printing head portion.

17. A printer, comprising:

a feeding unit configured to feed a print medium;

a printing head portion configured to print on the print medium;

a damper portion disposed at an upstream side of a feeding direction to give tension to the print medium; and a guiding portion disposed at the damper portion, the guiding portion contacting at least one side edge of the print medium to guide the feed of the print medium, wherein a depressed portion is formed on a part of a bottom surface within a printer chassis, and a part of the guiding portion is positioned within the depressed portion.

18. The printer according to claim 17, further comprising:

a medium supply unit configured to supply the print medium to the feeding unit.

19. The printer according to claim 17, wherein the feeding unit is further configured to feed the print medium in a direction opposite to the feeding direction.

20. The printer according to claim 17, wherein the print medium includes a liner sheet and a plurality of labels temporarily adhered at predetermined intervals along a longitudinal direction of the liner sheet.

21. The printer according to claim 17, wherein the guiding portion includes a guiding piece, the guiding piece includes an inclined surface which increases from an upstream side towards a downstream side with respect to the feeding direction, and the guiding piece abuts one side edge of the print medium.

22. The printer according to claim 17, wherein a lower end portion of the guiding portion is positioned between the bottom surface of the printer chassis and a bottom surface of the depressed portion.

23. The printer according to claim 17, wherein the guiding portion is disposed at a height beneath the printing head portion.

24. A printer, comprising:

a feeding unit configured to feed a print medium;

a printing head portion configured to print on the print medium;

a guiding unit that includes a guiding portion disposed upstream of the printing head portion in a printing direction; and a depressed portion formed in a floor surface of a printer chassis, wherein a part of the guiding portion is positioned within the depressed portion.

25. The printer according to claim 24, wherein
the guiding portion is away from a bottom surface of the depressed portion.

26. The printer according to claim 24, further comprising:
a damper portion configured to give tension to the print medium, wherein
the damper portion is swingably installed.

27. The printer according to claim 24, further comprising:
a damper portion configured to give tension to the print medium, wherein
the damper portion includes an outer damper portion and an inner damper portion, and
the inner damper portion is swingably supported on the outer damper portion.

28. The printer according to claim 27, wherein
the guiding unit is disposed on the outer damper portion.

29. The printer according to claim 27, wherein
the inner damper portion includes a paper sheet contact portion configured to contact the print medium, the paper sheet contact portion of the inner damper portion positioned downstream in the printing direction with respect to the depressed portion.

30. The printer according to claim 27, wherein
the inner damper portion is supported on an upstream side of the outer damper portion with respect to the printing direction,
the inner damper portion includes a paper sheet contact portion configured to contact the print medium,
the outer damper portion includes a paper sheet contact portion configured to contact the print medium, and
a height of the paper sheet contact portion of the inner damper portion is disposed at a lower position than a height of the paper sheet contact portion of the outer damper portion.

31. The printer according to claim 29, wherein
the paper sheet contact portion of the inner damper portion is positioned downstream of a paper sheet contact portion of the outer damper portion with respect to the printing direction.

32. The printer according to claim 24, wherein
the feeding unit is further configured to feed the print medium in a direction opposite to the printing direction.

33. The printer according to claim 24, wherein
the depressed portion is formed on a part of the floor surface within the printer chassis continuously to the floor surface.

34. The printer according to claim 24, wherein
the print medium includes a liner sheet and a plurality of labels temporarily adhered at predetermined intervals along a longitudinal direction of the liner sheet.

35. The printer according to claim 24, wherein
the guiding portion includes a guiding piece,
the guiding piece includes an inclined surface which increases from an upstream side towards a downstream side of the printing direction, and
the guiding piece abuts one side edge of the print medium.

36. The printer according to claim 24, wherein
a lower end portion of the guiding portion is positioned between the floor surface of the printer chassis and a bottom surface of the depressed portion.

37. The printer according to claim 24, wherein
the guiding unit is disposed at a height beneath the printing head portion.

* * * * *